US007191573B1

(12) United States Patent
Newton, II

(10) Patent No.: US 7,191,573 B1
(45) Date of Patent: Mar. 20, 2007

(54) STRUCTURAL PREFABRICATED COLUMN POST FOR SECURING TO THE GROUND

(76) Inventor: William Daniel Newton, II, 2734 E 45 Pl, Tulsa, OK (US) 74105

( * ) Notice: Subject to any disclaimer, the term of this patent is extended or adjusted under 35 U.S.C. 154(b) by 369 days.

(21) Appl. No.: 10/870,829

(22) Filed: Jun. 17, 2004

(51) Int. Cl.
*E04C 3/30* (2006.01)

(52) U.S. Cl. ..... 52/736.1; 52/170

(58) Field of Classification Search ..... 52/103, 52/736.1, 338.1, 737.4, 309.17, 309.12, 726.4, 52/159, 170, 40, 169.13, 296, 297, 301, 720.1, 52/736.2, 736.3, 704, 706, 708; 40/124.5; 256/DIG. 5, 65.14; 248/158, 523, 219.1, 248/219.2, 219.9
See application file for complete search history.

(56) References Cited

U.S. PATENT DOCUMENTS

| | | | | |
|---|---|---|---|---|
| 1,136,274 | A * | 4/1915 | Rigali | 52/103 |
| 3,570,376 | A * | 3/1971 | Overton et al. | 52/38 |
| 4,540,160 | A | 9/1985 | Zanavich et al. | |
| 4,543,757 | A | 10/1985 | Cosgrove | |
| 4,858,891 | A | 8/1989 | Boes | |
| 5,149,060 | A | 9/1992 | Boes | |
| 5,197,248 | A | 3/1993 | Kruse | |
| 5,359,827 | A | 11/1994 | Gehman | |
| 5,568,909 | A | 10/1996 | Timko | |
| 5,755,431 | A | 5/1998 | Williams | |
| 5,901,525 | A * | 5/1999 | Doeringer et al. | 52/736.4 |
| 6,098,353 | A | 8/2000 | Stanfield | |
| 6,467,756 | B1 | 10/2002 | Elsasser | |
| 2003/0089068 | A1 | 5/2003 | Ameigh | |

* cited by examiner

*Primary Examiner*—Naoko Slack
*Assistant Examiner*—Jonathan Junker
(74) *Attorney, Agent, or Firm*—Molly D. McKay

(57) ABSTRACT

A partially prefabricated column. The column has vented support pans and vertical ribs internally. Skin attaches to the vertical ribs. Rods secure to the bottom of the column and a concrete form is removably secured to the rods. Air gaps at the top and bottom of the column allow for air circulation through the column. A top attaches over the upper end of the column. A central tube is secured to the column via the support pans and is telescopically received within a receiver tube concreted into the ground. The column gently descends to the ground as the central tube inserts into the receiver tube. Concrete is then poured into the concrete form and the concrete troweled between a notched plastic angle member on the bottom of the column and the concrete form. The concrete cures, the form is removed and the ends of the rods are plugged.

16 Claims, 12 Drawing Sheets

STRUCTURAL PREFABRICATED COLUMN POST FOR SECURING TO THE GROUND

BACKGROUND OF THE INVENTION

1. Field of the Invention

The present invention relates to a column that is partially prefabricated so that a homeowner or contractor can install the column to achieve professional looking results while employing a minimum of time, tools, money, and effort. The column can be used for a variety of purposes, including use for a fence, trellis, arbor, or porch support or as a supporting column for a mailbox.

The column is provided with a central tube and with Z-shaped tabs that secure the column to rods. The central tube and the rods are employed to secure the column to a receiver tube concreted into ground. The column is also provided internally with horizontal support pans that secure to the central tube and with vertical ribs that secure to the support pans to form the internal structural support for the column. A skin of metal or other suitable material secures to the vertical ribs with double sided tape. The skin can be formed in patterns and can optionally be finished with paint, stucco, or other suitable coating material.

2. Description of the Related Art

Currently estate-type columns are generally constructed of brick, concrete, or wood and are costly and time consuming to construct. Also, because the columns are built on site, in order to construct a nice looking column, skilled masons or carpenters generally must be employed to do the construction. For this reason, construction of these types of columns has, until now, been projects that most homeowners have not felt confident in tackling as a do-it-yourself project.

The present invention addresses these drawbacks of current column construction by providing a partially prefabricated column that is simple enough to install that a homeowner or a contractor can easily, quickly, and inexpensively install the column with professional looking results. Installation does not require a skilled workman and can be accomplished with only a few, commonly available tools. The present column is constructed of metal or of synthetic materials or of a combination of metal and synthetic materials that will last for years without deterioration. The column is versatile and can be used as a fence post, trellis, arbor, or a porch support. Also, with only slight modifications, the column can be used as a support column for a mailbox.

SUMMARY OF THE INVENTION

The present invention is a column that is partially prefabricated so that a homeowner or contractor can install the column employing a minimum of time, tools, money, and effort. The column is provided with a central tube that is initially detached from the remainder of the column. First, the tube is removably attached to a receiver tube and is used to plumb the receiver tube as the receiver tube is installed into the ground and as concrete used to secure the receiver tube in the ground is poured around the receiver tube.

After the concrete cures, the tube is then removed from the receiver and is next attached internally in the center of the column to horizontal support pans that are provided within the column for this purpose. The support pans were previously secured via pop rivets to vertical ribs so that the pans, ribs and the central tube form the skeletal structural components for the column. The skin also was previously secured onto the exterior of the column by attaching it to the vertical ribs with double sided tape. The skin may be plain, as illustrated in FIG. 26, or alternately may be preformed into a variety of patterns or shapes, as illustrated in FIGS. 1, 27, and 28. Vertical edges of the skin were previously secured together with double sided tape, the gap then filled with caulk and then the exterior surfaces of the column, including the top, were finished with the desired finish material. Finish material may be paint, powder coating, stucco material, or any other suitable type of finish or coating material.

Once the tube has been installed within the column, four Z-shaped tabs provided internally at the lower end of the column are pivoted downward and two rods are inserted through opposing Z-shaped tabs and the tube in a criss-cross pattern. A concrete form is secured to the rods by inserting bolts through predrilled holes in the concrete form and threading the bolts into female thread provided at each end of the rods.

A notched plastic angle member is pre-attached to the bottom of the column that will serve three functions: it will provide an upper edge for leveling the concrete within the concrete form, it serves to protect the column from the caustic base, and the notched areas will provide air gaps at the bottom of the column to allow air to circulate through the interior of the column. Each of the support pans are provided with openings in them to allow for air circulation within and through the column. The openings in the support pans also provide access to help in the insertion of the central tube through the support pans. Also, spacer tabs are provided at the top of the column to hold the top of the column off of the side walls to form an air gap at the top of the column so that air can flow freely through the entire height of the column. Because the column may be constructed either completely or partially of metal, it is important to have air circulation within the column to prevent the accumulation of moisture and rusting inside the column.

The top attaches to the upper end of the column via spring clips that are taped with double sided tape at the top of the exterior surface of the column. As the top is lowered over the top of the column, the spring clips are depressed, thereby allowing the top to pass over the spring clips. Once the lower lip of the top has passed over the spring clips, the outwardly biased spring clips spring outward to capture the lower lip of the top and thereby secure the top to the upper end of the column.

After the concrete form has thus been secured to the column, the central tube, with the column attached, is inserted into the receiver tube that has previously been installed in the ground. The top of the receiver tube opening is flared for ease in inserting the central tube into the receiver tube. The receiver tube is provided with an external cap at its lower end and the central tube is provided with an internal cap at its lower end. These two caps serve to create an air cushion that allows the central tube to be gentle lowered into the receiver tube as the air that is trapped between the internal and external caps escapes upward through the gap formed between the central tube and receiver tube until the air exits the receiver tube at its flared top end.

As the air escapes out of the receiver tube, the column slowly descends to the ground until the bottom of the concrete form comes to rest on a flattened area that was dug for this purpose surrounding the receiver tube. The flattened area is preferably at an elevation slightly below the normal ground level so that after the concrete is poured into the concrete form and the form is removed from the column, dirt can be backfilled around the concrete base. This creates a neat, finished appearance to the concrete base. When the concrete form is removed from the column, the female threaded ends of the rods will be visible on the sides of the concrete base. These rod ends can be concealed prior to backfilling dirt around the concrete base either by employing a plug that threads into the female threaded ends or by covering the ends with caulk.

DETAILED DESCRIPTION OF THE PREFERRED EMBODIMENT

The Invention

Figure 1:
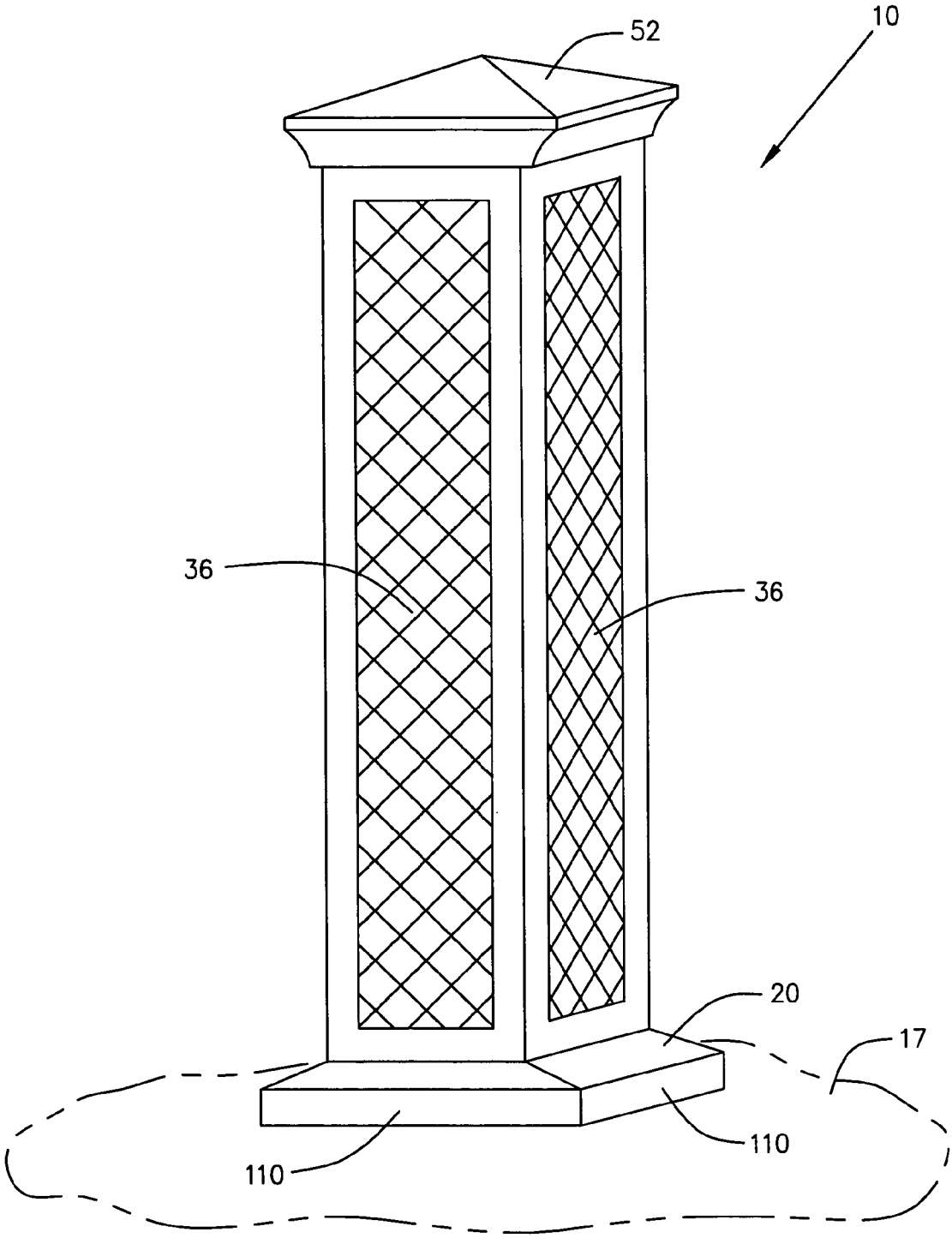
FIG. 1 is a perspective view of a column constructed in accordance with a preferred embodiment of the present invention.
Figure 2:
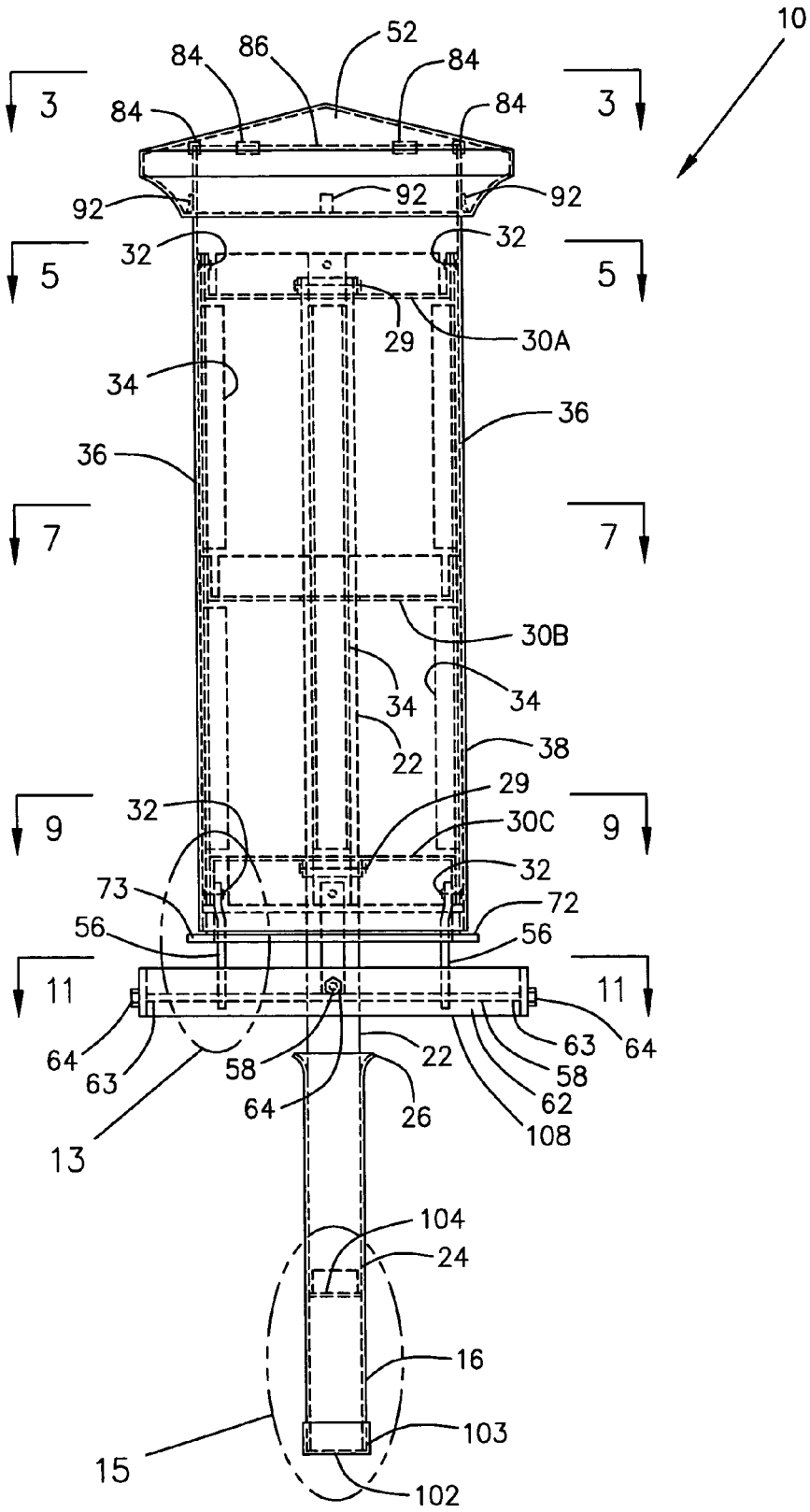
FIG. 2 is a front view of the column of FIG. 1 showing the internal components in outline.

Referring now to the drawings and initially to FIGS. 1 and 2, there is illustrated a column 10 constructed in accordance with a preferred embodiment of the present invention. The column 10 is partially prefabricated so that a homeowner or contractor can install the column 10 employing a minimum of time, tools, money, and effort.

Figure 23:
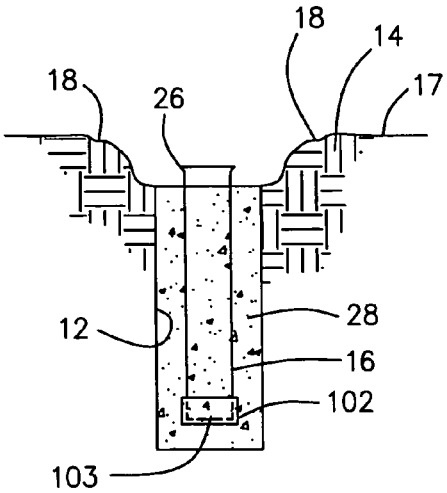
FIG. 23 is a front view of a receiver tube for the center tube shown installed in the ground.
Figure 24:
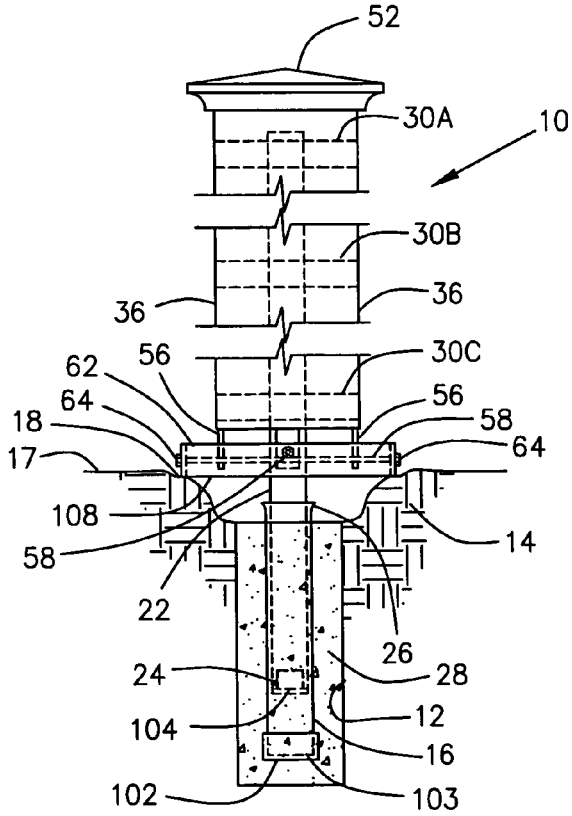
FIG. 24 is a front view of the column of FIG. 22 with the center tube inserted into the receiver tube of FIG. 23.
Figure 25:
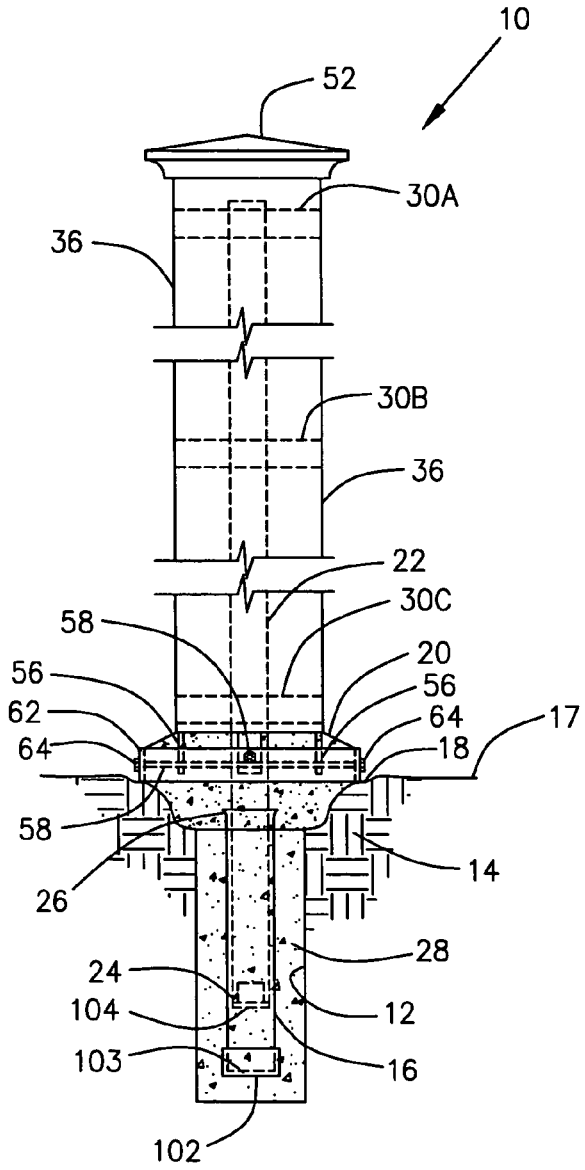
FIG. 25 is a front view of the column of FIG. 24 with a concrete base poured within the concrete form.

First, as illustrated in FIG. 23, a hole 12 is dug in the ground 14 with the hole 12 being sufficiently large and deep to allow a receiver tube 16 to be secured at the proper elevation relative to ground level 17, per the column manufacturer's instructions for installation. The receiver tube 16 of FIGS. 23–25 is shown installed with the flared upper end 24 of the receiver tube 16 located approximately two inches below ground level 17, although the invention is not limited to this exact depth. At the same time that the hole 12 is dug in the ground 14, a flattened area 18 is formed in the ground level 17 surrounding the hole 12 as a place on which a concrete base 20 for the column 10 will later be poured later in the installation process, as will be more fully described hereafter.

The column 10 is provided with a central tube 22 that is initially detached from the remainder of the column. A bottom end 24 of the central tube 22 is telescopically inserted into a flared upper end 26 of the receiver tube 16, and the central tube 22 is removably attached to the receiver tube 16, preferably by means of duct tape (not illustrated) or other suitable removable fastening means. The central tube 22 remains attached to the receiver tube 16 and is used to plumb the receiver tube 16 as the receiver tube 16 is installed into the hole 12 in the ground 14 and as concrete 28 is poured around the receiver tube 16 to secure the receiver tube 16 in the ground 14. The concrete 28 is poured so that it does not cover the flared upper end 26 of the receiver tube 16.

After the concrete 28 cures, the duct tape is removed from the central tube 22 and the receiver tube 16, and the central tube 22 is then removed from the receiver tube 16. The central tube 22 is then attached in the center of the column 10 via bolts 29 that secure the central tube 22 to the upper and the lower horizontal support pans 30A and 30C that are provided internally within the column 10 for this purpose. Referring to FIGS. 5, 6, 9, and 10, the upper and lower horizontal support pans 30A and 30C are identical except that the lower support pan 30C has been flipped over 180 degrees so that its flanged central opening 33 extends downward instead of upward. This orientation allows the installer to reach the flanged center opening 33 easier when attaching the central tube 22 to the support pans 30A and 30C, as described below. Each support pan 30A, 30B, and 30C is provided with raised reinforcements 37 to strengthen the pan 30A, 30B, 30C.

Figure 6:
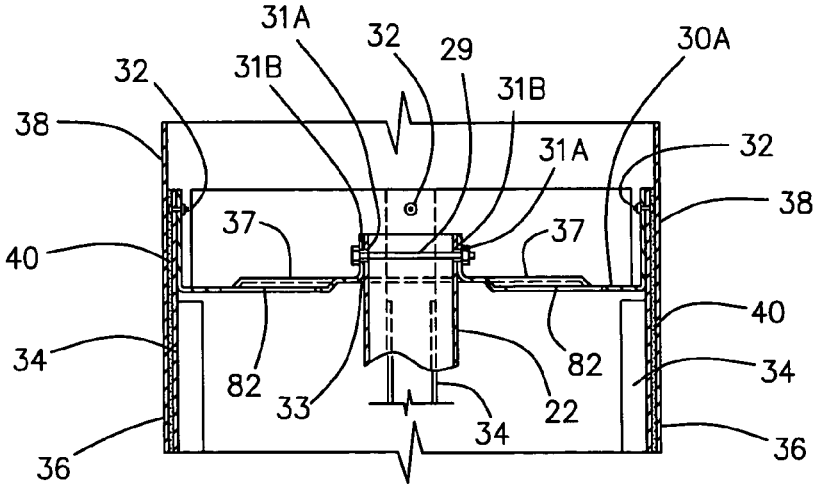
FIG. 6 is a cross section view taken along line 6—6 of FIG. 5.
Figure 10:
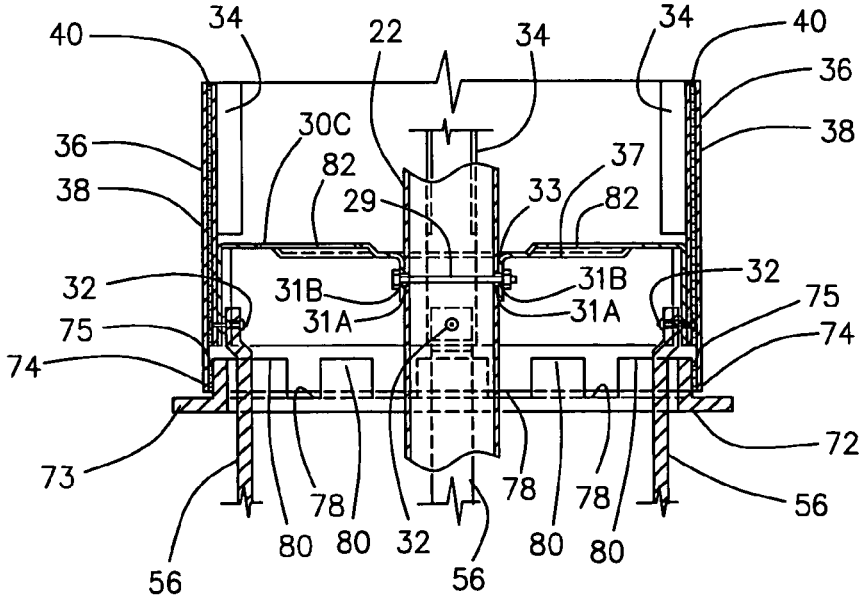
FIG. 10 is a cross section view taken along line 10—10 of FIG. 9.

Referring to FIGS. 6 and 10, aligned bolt openings 31A are provided extending horizontally through the central tube 22 and aligned bolt openings 31B are provided extending horizontally through a flanged central opening 33 provided in both the upper and lower horizontal support pans 30A and 30C for this purpose.

Figure 7:
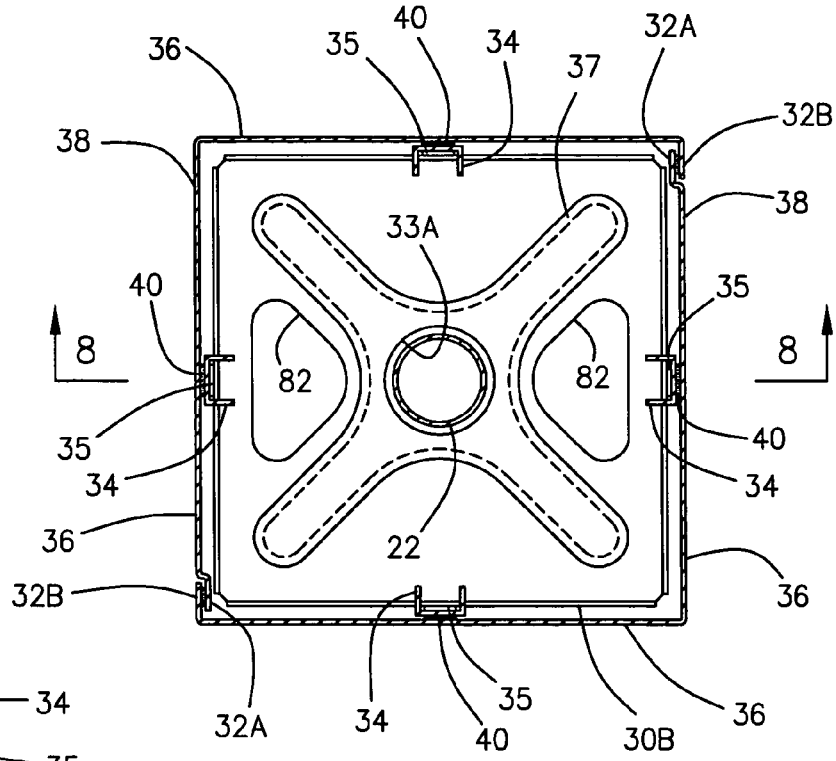
FIG. 7 is a cross sectional view taken along line 7—7 of FIG. 2.
Figure 7A:
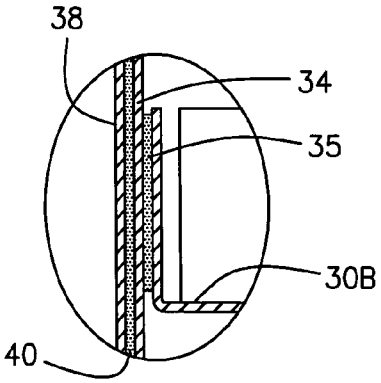
FIG. 7A is an enlarged view of the portion contained within circle 7A of FIG. 8.
Figure 8:
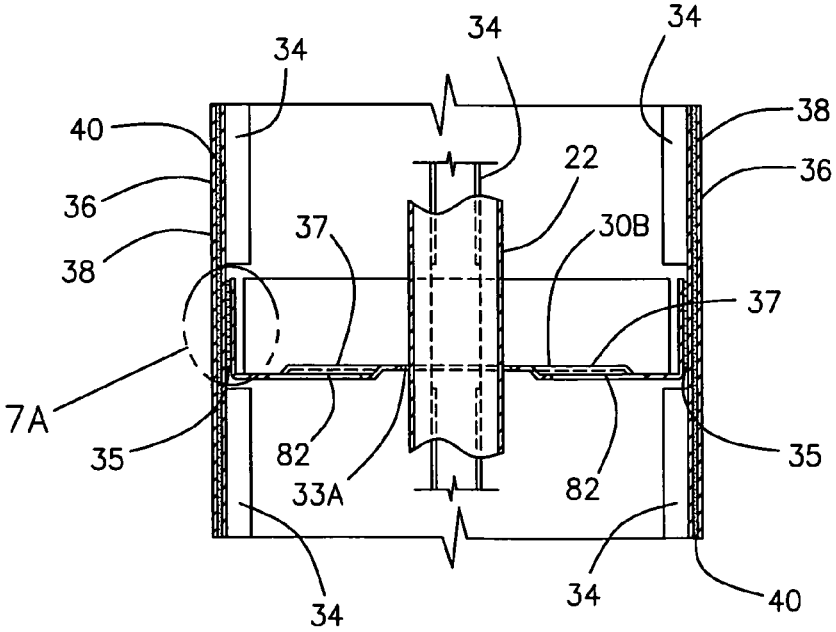
FIG. 8 is a cross sectional view taken along line 8—8 of FIG. 7.
Figure 9:
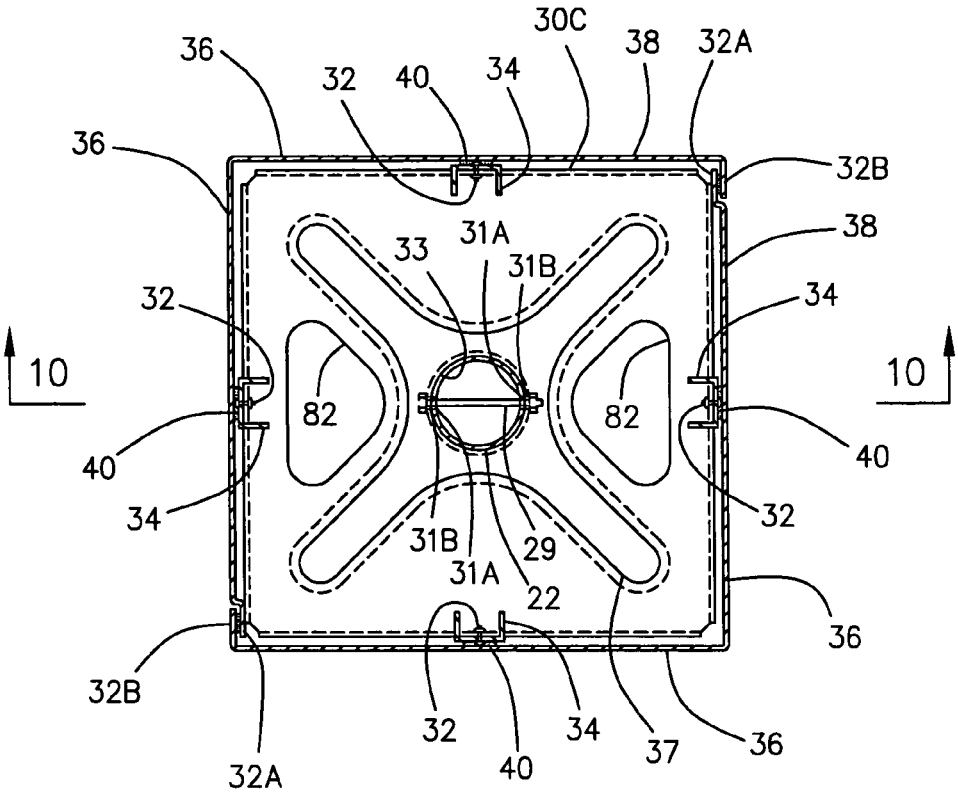
FIG. 9 is a cross sectional view taken along line 9—9 of FIG. 2.
Figure 18:
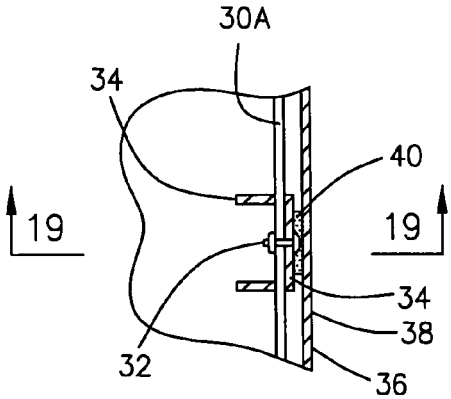
FIG. 18 is an enlarged view of the portion contained within circle 18 of FIG. 5.
Figure 19:
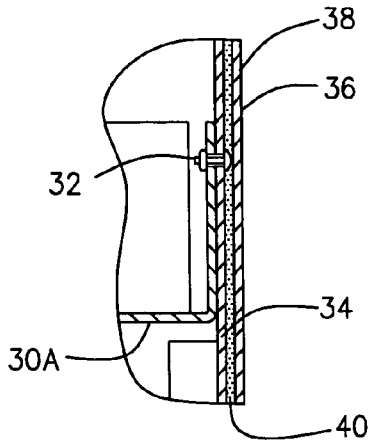
FIG. 19 is a cross sectional view taken along line 19—19 of FIG. 18.

Referring now to FIGS. 1, 7 and 8, although the column 10 may also be provided with a middle horizontal support pan 30B located between the upper and lower horizontal support pans 30A and 30C, the user will not be able to reach into the column 10 to secure the center tube 22 to the middle horizontal support pan 30B. The middle support pan 30B is provided only with a central opening 33A for the central tube 22 since the central tube 22 does not secure to the middle support pan 30B. Also, it is not necessary for the central tube 22 to attach to the middle horizontal support pan 30B because, as illustrated in FIGS. 5, 6, 9, and 10, and in detail in FIGS. 7A, 18 and 19, and the top and bottom support pans 30A and 30C were previously secured together via pop rivets 32 to vertical ribs 34 provided internally along the middle of each wall 36 of the column 10 and the middle support pan 30B was previously also secured to the vertical ribs 34 by means of two sided tape 35, thereby forming the pans 30A, 30B, and 30C; the ribs 34; and the central tube 22 into a unitary skeletal supporting structural for the column 10.

Figure 17:
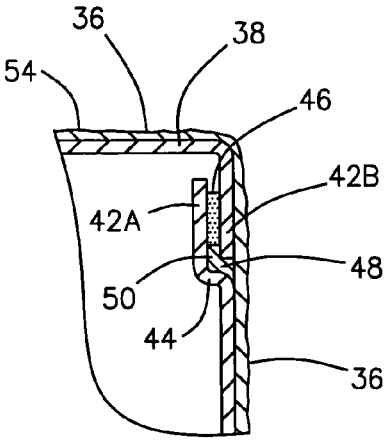
FIG. 17 is an enlarged view of the portion contained within circle 17 of FIG. 5.
Figure 26:
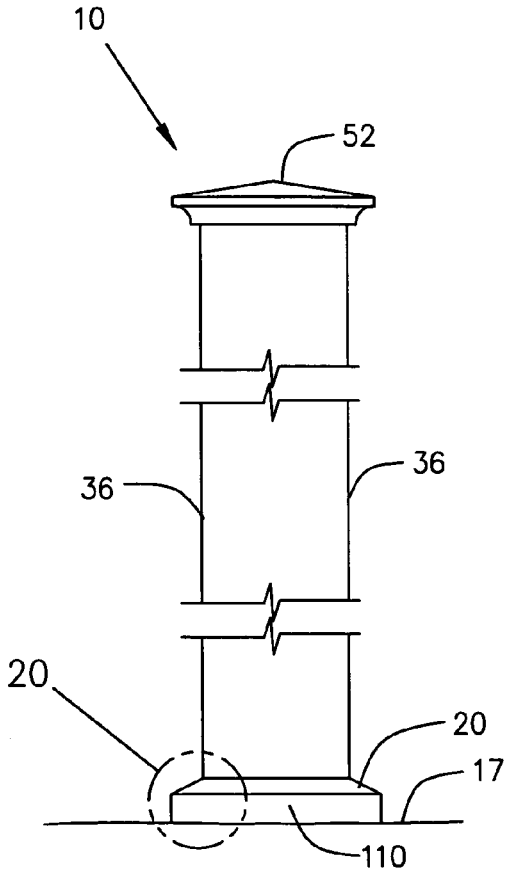
FIG. 26 is a front view of the column of FIG. 25 showing the column of FIG. 25 after the concrete form is removed.

A skin 38 also was previously attaching it to the vertical ribs 34 with double sided tape 40 to form the exterior surface of the column 10. The skin 38 may be plain, as illustrated in FIG. 26, or alternately may be pre-formed into a variety of patterns or shapes, as illustrated for example in FIGS. 1, 27, and 28. Vertical edges 42A and 42B of the skin 38 were previously secured together with double sided tape 40. As illustrated in FIG. 17, one of the vertical edges 42A is provided with an inward indentation 44 that allows the other vertical edge 42B to slightly overlap the first vertical edge 42A so that they can be secured together with double sided tape 48 while maintaining a straight wall 36. A gap 50 is formed externally on the wall 36 at the junction of the vertical edges 42A and 42B. The gap 50 was preferably filled with paintable silicone caulk 50 and then the exterior surfaces of the column, including the walls 36 and a top 52 of the column 10, were finished with the desired finish material 54. Finish material may be paint, powder coating, stucco material, or any other suitable type of finish or coating material.

Figure 11:
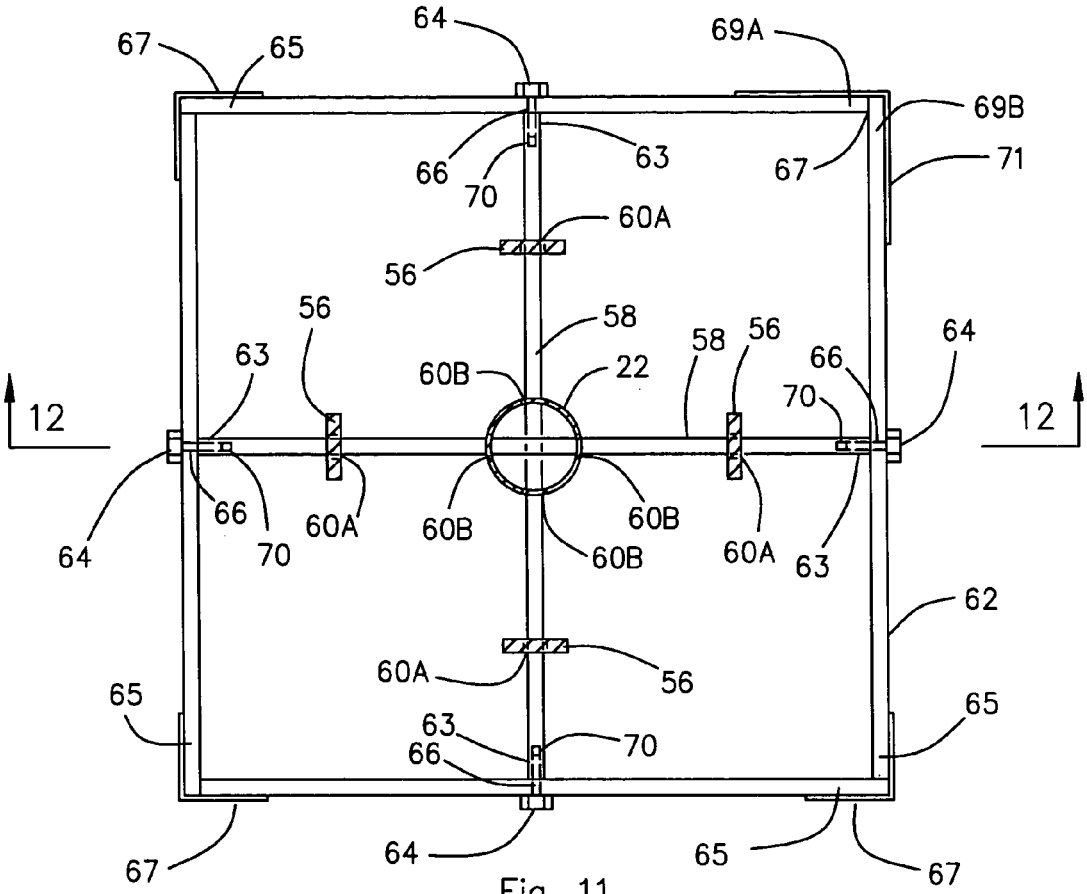
FIG. 11 is a cross sectional view taken along line 11—11 of FIG. 2.

Once the central tube 22 has been installed within the column 10, the column 10 is next prepared to be secured to the ground 14 with a concrete base 20. A concrete form 62 must be attached to the column 10. Referring to FIG. 11, the concrete form 62 is preferably initially delivered to the installer as a four sided, flat strip of material that has four rigid portions that will form the side walls 65 of the concrete form 62. Each rigid portion or side wall 65 is separated from its adjacent rigid portion or side wall 65 by flexible corners 67 so that the flat strip can be bent at the corners 67 and can be secured together at its two opposite open ends 69A and 69B with openable plastic corner 71 or other similar removable fastening means to form a square sleeve that will serve as the concrete form 62 for pouring concrete for the base 20.

Figure 12:
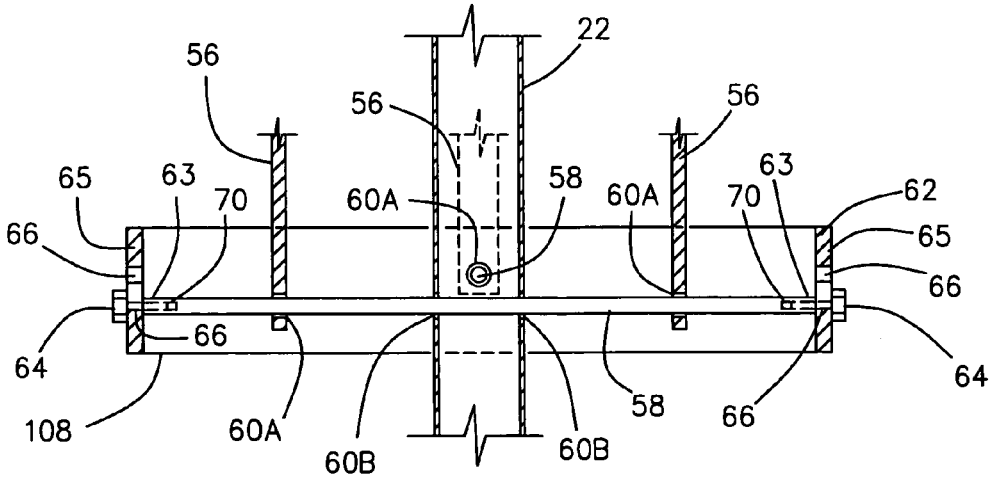
FIG. 12 is a cross sectional view taken along line 12—12 of FIG. 11.
Figure 13:
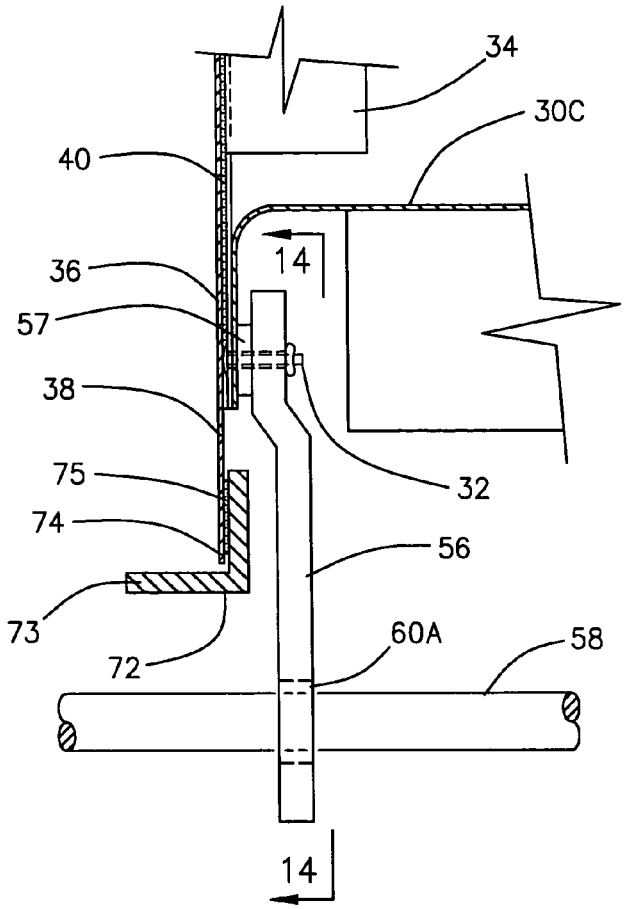
FIG. 13 is an enlarged view of the portion contained within circle 13 of FIG. 2.
Figure 14:
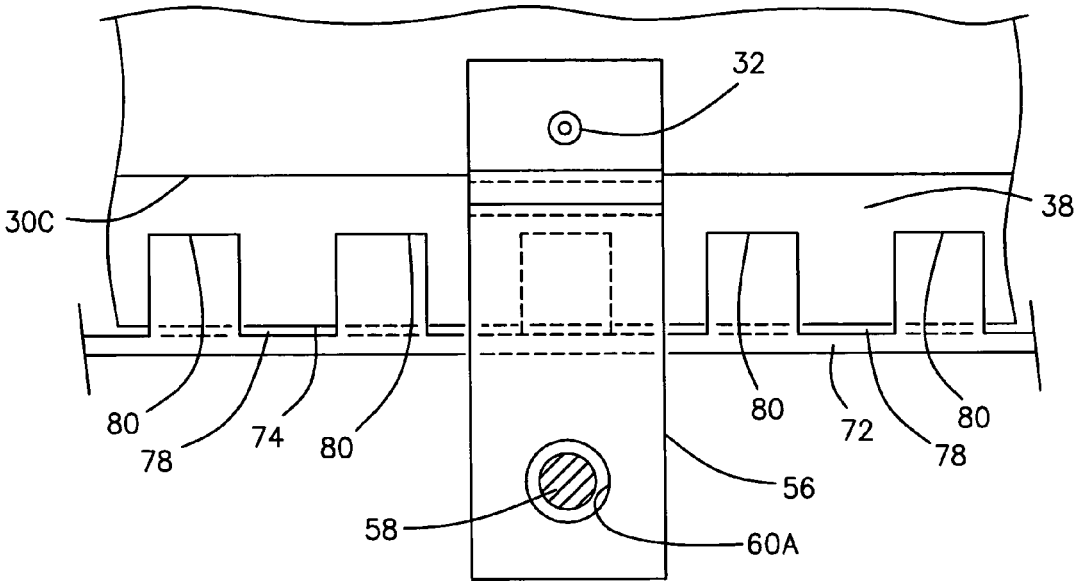
FIG. 14 is a cross sectional view taken along line 14—14 of FIG. 13.
Figure 21:
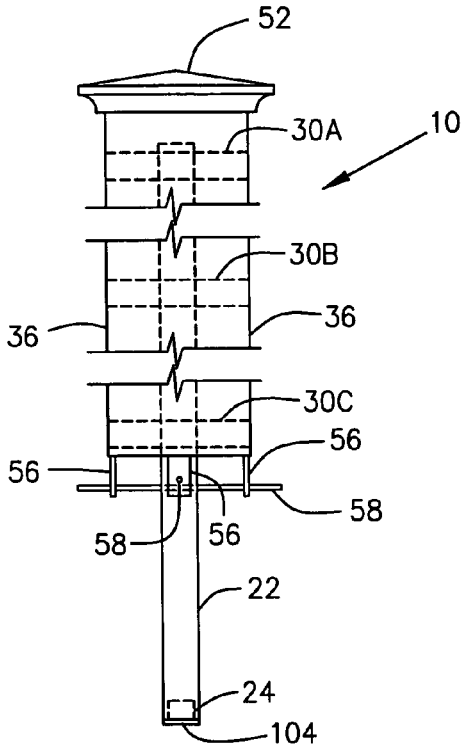
FIG. 21 is a front view of the column of FIG. 2, showing a center tube secured within the column and a first rod attached to the column.
Figure 22:
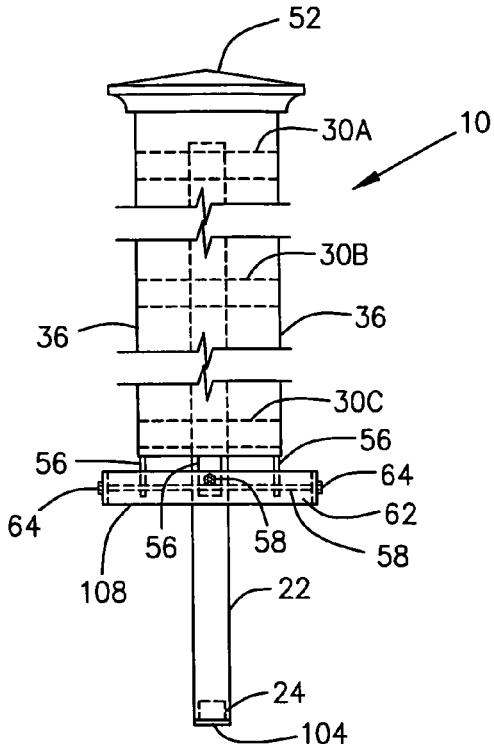
FIG. 22 is a front view of the column of FIG. 21, showing a second rod and a concrete form attached to the column.

Next, as shown in FIGS. 13, 14 and 21, four Z-shaped tabs 56 that are secured to the lower support pan 30C via pop rivets 32 are pivoted at the pop rivets 32 into a downward orientation from their initial stored horizontal orientation. The Z-shaped tabs 56 are each spaced apart from the bottom pan 30C via a washer 57. Also referring to FIGS. 11 and 12, then two rods 58 are inserted in a criss-cross pattern through rod openings 60A provided in opposing Z-shaped tabs 56 and through rod openings 60B provided in the central tube 22 for this purpose. These rods 58 have three functions. They serve as reinforcing rods for the concrete base 20, they secure the column 10 to the concrete base 20, and they secure the concrete form 62 in the proper position relative to the column 10. As illustrated in FIGS. 11, 12, and 22, a concrete form 62 is then secured to ends 63 of the rods 58 by first inserting bolts 64 through predrilled holes 66 in walls 65 of the concrete form 62 and then threading the bolts 64 into female threads 70 provided in each end 63 of the rods 58. The rods 58 serve three purposes: they serve a place for the concrete form 62 to removably attach to the column 10, they serve as a means of securing the column 10 to its concrete base 20, and they serve as reinforcement to the concrete base 20.

Figure 3:
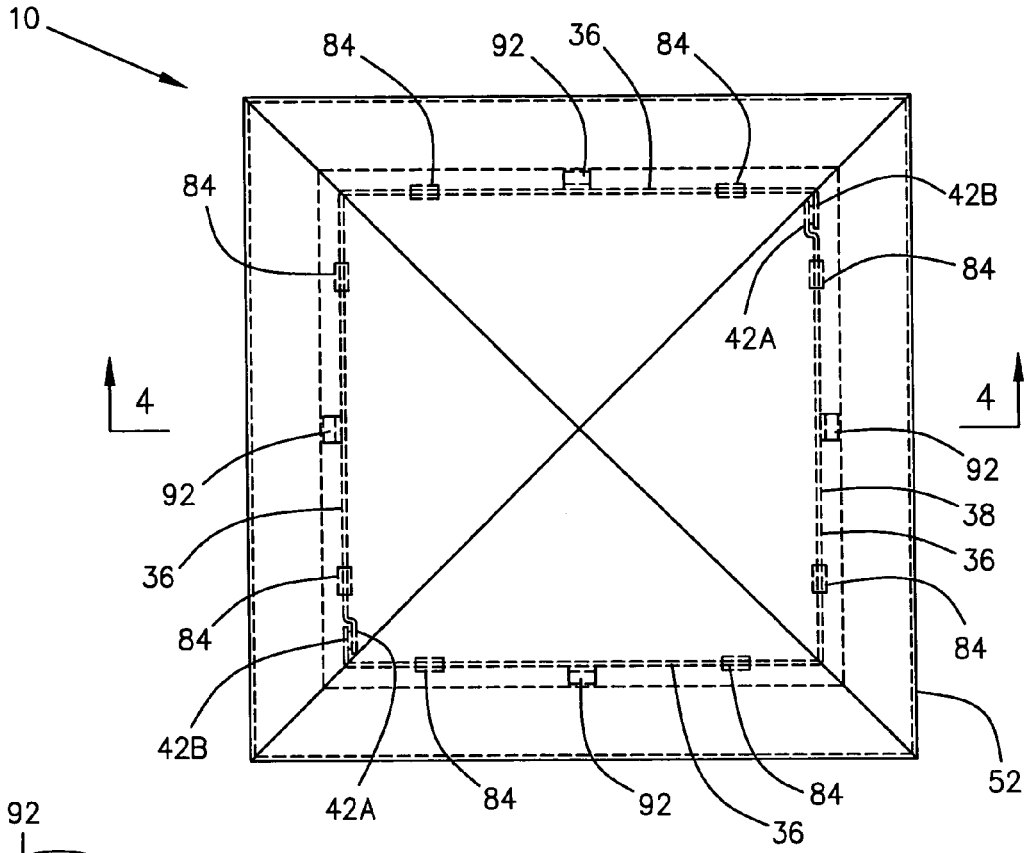
FIG. 3 is a cross sectional view taken along line 3—3 of FIG. 2.
Figure 4A:
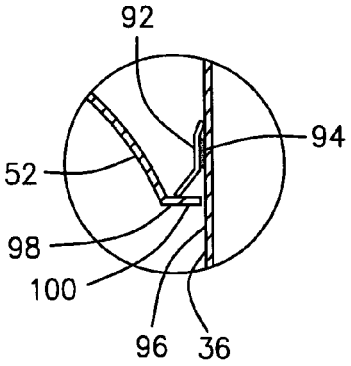
FIG. 4A is an enlarged view of the portion contained within circle 4A of FIG. 4.
Figure 4:
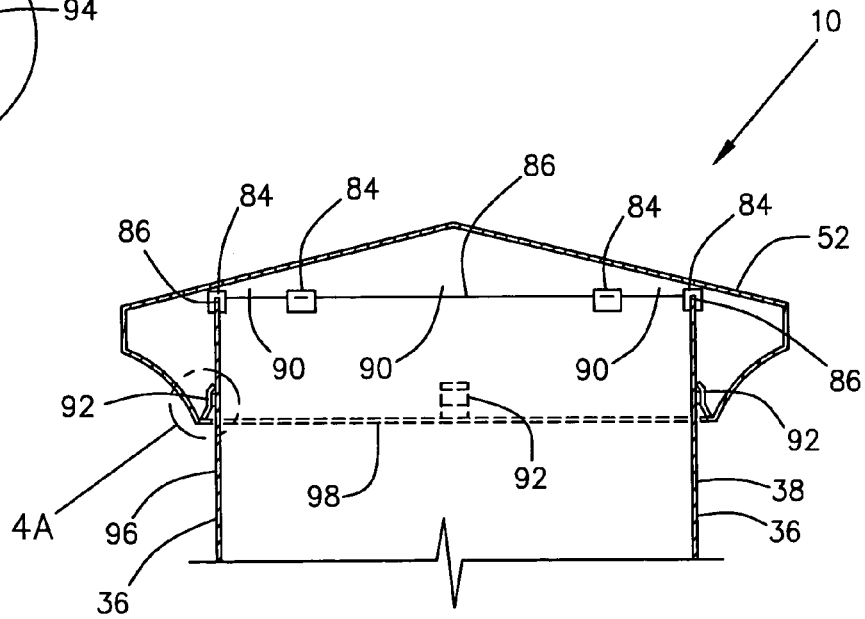
FIG. 4 is a cross sectional view taken along line 44 of FIG. 3.
Figure 5:
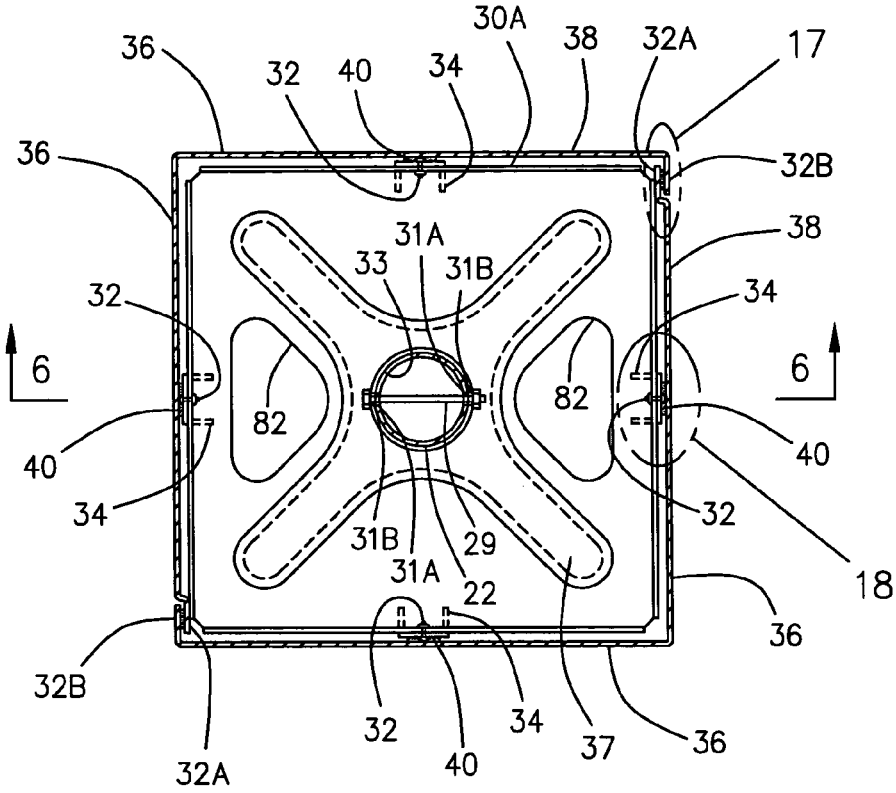
FIG. 5 is a cross sectional view taken along line 5—5 of FIG. 2.
Figure 20:
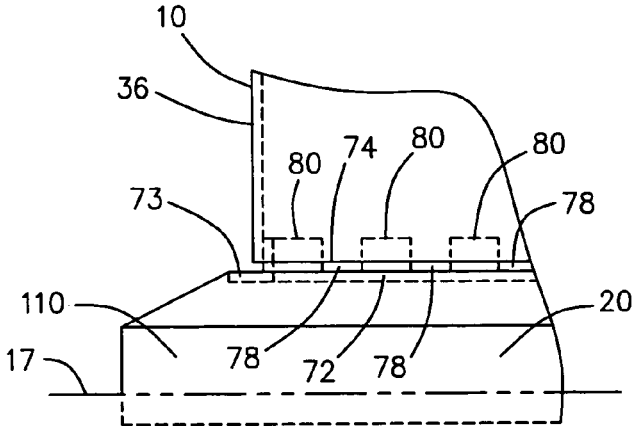
FIG. 20 is an enlarged view of the portion contained within circle 20 of FIG. 26.

Referring to FIGS. 13 and 14, a notched plastic angle 72 is pre-attached internally at a bottom edge 74 of the walls 36 of the column 10 employing double sided tape 75. The notched plastic angle 72 serves three functions. First, it is provided with an outwardly extending lower lip 73 that serves as an upper guiding edge for screeding or troweling a second pour of concrete that will be poured into the concrete form 62 to form the base 20, as illustrated in FIGS. 20 and 25. Second, notched areas 78 are provided on the upwardly extending portion 80 of the plastic angle 72 and extend below the bottom edge 74 of the walls 36, thereby providing air gaps at the bottom edge 74 of the column 10 which allow air to circulate through the interior of the column 10, as illustrated in FIGS. 10, 14, and 20. Finally, the plastic angle 72 separates the metal column 10 from the caustic concrete base 20, thereby reducing the potential for corrosion of the metal. To aid in air circulation internally within the column 10, each of the support pans 30A, 30B, and 30C is provided with air openings 82 in them. These air openings 82 are also useful in allowing the installer to reach through them to the interior of the column 10. Also, as illustrated in FIGS. 3 and 4, to insure air circulation in the upper end of the column 10, spacer tabs 84 are attached to a top edge 86 of the walls 36 of the column 10. These spacer tabs serve to hold the top 52 that attaches over the walls 36 and forms the uppermost part of the column 10 off of the top edge 86 of the side walls 36, thus forming an air gap 90 at the top edge 86 of the walls 36 so that air can flow freely through the entire height of the column 10. It is important to have air circulation within the column 10 to prevent the accumulation of moisture and rusting inside the column 10.

After the central tube 22 and the concrete form 62 have thus been secured to the column 10, the central tube 22 is inserted into the flared upper end 26 of the receiver tube 16 that was previously installed in the ground 14. The receiver tube 16 is provided with its upper end 26 flared to make it easier for the installer to insert the central tube 22 into the receiver tube 16 since the two tubes 22 and 16 are constructed so that there is a close fit between them when the central tube 22 is inserted into the receiver tube 16.

Figure 15:
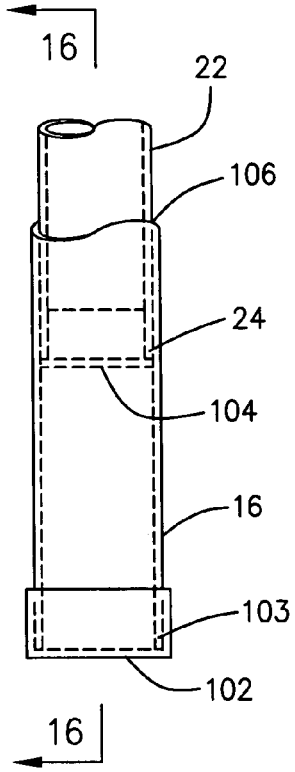
FIG. 15 is an enlarged view of the portion contained within circle 15 of FIG. 2.
Figure 16:
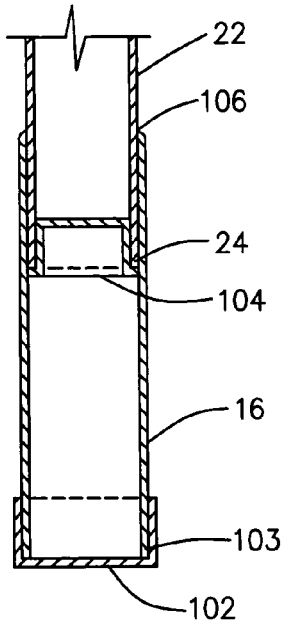
FIG. 16 is a cross section view taken along line 16—16 of FIG. 15.

Referring to FIGS. 15, 16, and 24, the receiver tube 16 is provided with an external cap 102 at its bottom end 103, and the central tube 22 is provided with an internal cap 104 at its bottom end 24. The external cap 102 initially serves to prevent concrete 28 from entering the bottom end 108 of the receiver tube 16 as the receiver tube 16 is secured with concrete 28 in the ground 14. This external cap 102 and the internal cap 104 jointly serve to create an air cushion that allows the central tube 22 and the attached column 10 to be gently lowered into the receiver tube 16 as air that is trapped between inside the receiver tube 16 between the internal and external caps 104 and 102 gradually escapes upward through an air gap 106 formed between the central tube 22 and the receiver tube 16 and exits the receiver tube 16 via its flared top end 26.

As air escapes out of the receiver tube 16, the column 10 slowly descends to the ground 14 until a bottom 108 of the concrete form 62 comes to rest on the flattened area 18 that was dug for this purpose surrounding the receiver tube 16. The flattened area 18 is preferably at an elevation slightly below the normal ground level 17 so that after the base 20 is poured and the concrete has cured so that the concrete form 62 can be removed from the column 10, as shown in FIG. 26, dirt can then be backfilled around the concrete base 20, as shown in FIG. 20. This creates a neat, finished appearance to the concrete base 20.

After the column 10 has been secured to the base 20, the top 52 is secured to the column 10. Referring to FIGS. 3, 4 and 4B, the top 52 attaches to the top edge 86 of the walls 36 of the column 10 via spring clips 92 that are taped with double sided tape 94 near the top edge 86 on an exterior surface 96 of each wall 36. To install the top 52, a bottom end 98 of the top 52 is lowered over the top edges 86 of the walls 36. As a lower, inwardly extending lip 100 provided on the top 52 passes over the spring clips 92, the spring clips 92 are depressed, thereby allowing the lower lip 100 of the top 52 to pass over the spring clips 92. Once the lower lip 100 of the top 52 has passed over the spring clips 92, the normally outwardly biased spring clips 92 spring outward to capture the lower lip 100 of the top 52 and thereby secure the top 52 to the walls 36 of the column 10.

When the concrete form 62 is removed from the column 10, the female threaded ends 63 of the rods 58 will be visible on the sides 110 of the concrete base 20. These rod ends 63 can be concealed prior to backfilling dirt around the concrete base 20 either by employing a plug (not illustrated) that engages the female threaded ends 63 or by covering the ends 63 with silicone caulk.

Although not illustrated, a decorative finale, or alternately, a light fixture can be added to the top 52 or wall 36 of the column 10, if desired. These optional items are installed by drilling a hole, if necessary to admit wiring, in the column 10 and then securing the optional item to the column, preferably with self drilling, self tapping screws.

Figure 27:
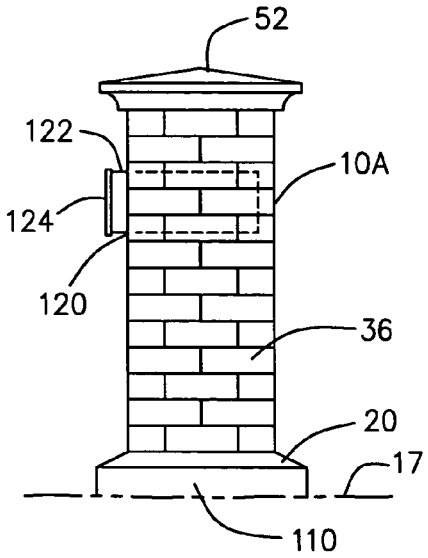
FIG. 27 is a side view of a second alternate embodiment of the present invention showing the column of FIG. 1 that has been modified for use as a mail box column.
Figure 28:
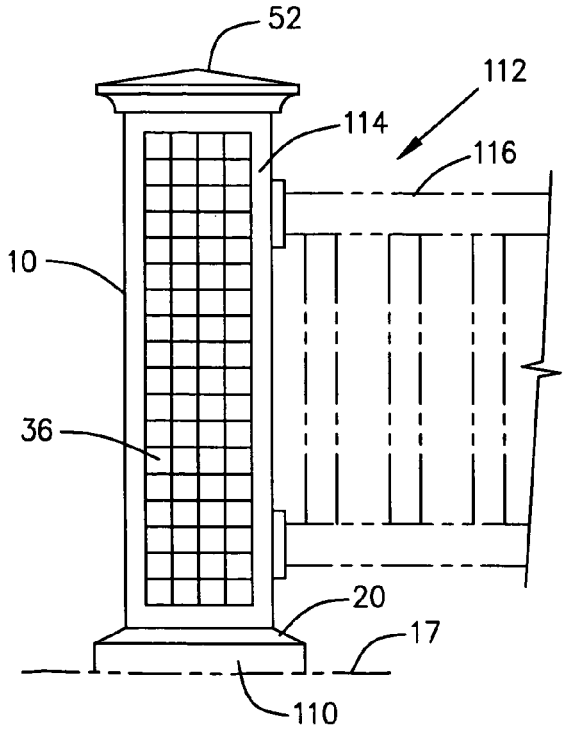
FIG. 28 is a front view of a typical installation of the column of FIG. 1 with a fence panel attached to the column.
Figure 29:
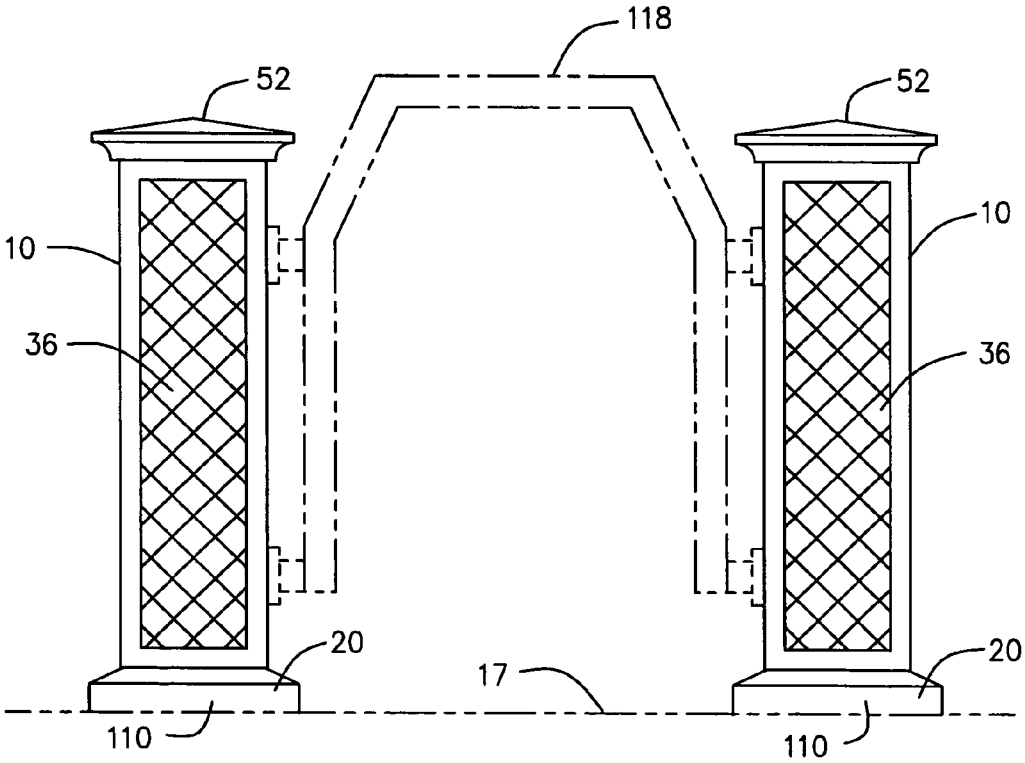
FIG. 29 is a front view of an alternate installation of a pair of columns of FIG. 1 shown attached to an arched trellis.

Referring now to FIGS. 27–29, there are illustrated a few of the many uses for the column 10. FIG. 28 shows a column 10 used in a fence 112 as a 114 with a fence panel 116 secured to a wall 36 of the column 10, preferably so that the fence panel 116 secures with self drilling, self tapping screws (not illustrated) at least to one or more of the support pans 30A, 30B, and 30C located within the column 10. FIG. 29 shows an arched trellis member 118 secured on either side to a column 10. The arched trellis member 118 secures to the columns 10 in a similar manner as described in relationship to the fence panel 116 of FIG. 28.

FIG. 27 is an alternate embodiment of the column 10A that has been shortened in height, has had the central tube 22 shortened so that it extends upward at least through the bottom support pan 30C, and has had a mailbox opening 120 created in one wall 36 of the column 10A so that a standard mailbox 122 can be inserted via the mailbox opening 120 inside the column 10 with the door 124 and secured within the column 10 so that the mailbox 122 extending outward from the mailbox opening 120.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A column comprising:

a central tube, means for securing a first end of said central tube in the ground, an opposite second end of said central tube inserted through an opening provided in each of at least two horizontal support pans, said central tube secured to each said horizontal support pan, vertical ribs extending between the horizontal support pans, a skin secured around the support pans and secured to the vertical ribs by double sided tape to form walls of a column shaped member so that the vertical ribs are centered on each wall of the column shaped member, and a top secured over the top edges of the walls of said column shaped member.

2. A column according to claim 1 wherein the means for securing a first end of said central tube in the ground further comprises:

tabs pivotably secured to a bottom of the walls of said column shaped member, and each said tab pivoting downward below the walls of said column so that each tab extends into a concrete base, said concrete base securing the first end of the central tube in the ground.

3. A column comprising:

a central tube, means for securing a first end of said central tube in the ground, an opposite second end of said central tube inserted through an opening provided in each of at least two horizontal support pans, said central tube secured to each said horizontal support pan, a skin secured around the support pans to form walls of a column shaped member, a top secured over the top edges of the walls of said column shaped member tabs pivotably secured to a bottom of the walls of said column shaped member, each said tab pivoting downward below the walls of said column so that each tab extends into a concrete base, said concrete base securing the first end of the central tube in the ground, at least two rods extending through openings provided in the central tube and through openings provided in a distal end of each of the tabs so that the rods cross each other and are approximately horizontally oriented within the concrete base.

4. A column according to claim 3 wherein the means for securing a first end of said central tube in the ground further comprises:

the ends of each said rod provided with female threads for receiving a bolt therein as a means of removably securing to the central tube a concrete form into which concrete is poured to create the concrete base.

5. A column according to claim 4 wherein the means for securing a first end of said central tube in the ground further comprises:

a receiver tube secured in the ground, and an upper end of said receiver tube flared outward in order to receive a first end of said central tube within said receiver tube.

6. A column according to claim 5 wherein the means for securing a first end of said central tube in the ground further comprises:

an external cap provided on a bottom end of said receiver tube, an internal cap provided on bottom end of said central tube, and said receiver tube sized slightly larger than said central tube so that there is a close fit between them when the bottom end of the central tube is telescopically inserted into the flared upper end of the receiver tube.

7. A column according to claim 6 further comprising:

a notched angle member secured to a bottom edge of the walls of the column shaped member to allow air to circulate into column shaped member via notched areas in the angle member, said angle member provided with a lower lip that extends outward from the walls and serves as an edge for forming the concrete base between the lip and the concrete form, and spacers provided between the top edges of said walls and the top to form air gaps at the top edge of the walls so that air can flow through the column shaped member.

8. A column according to claim 7 further comprising:

outwardly biased spring clips secured to exterior surfaces at the top edges of the walls of the column shaped member, and said spring clips capturing a lower lip of the top to thereby secure the top to the upper end of the column by depressing as the top is lowered over the top of the column and by springing back into their original configuration once the lower lip of the top has passed over the spring clips.

9. A column according to claim 8 further comprising:

vertical oriented ribs provided internally within the column shaped member between the skin and the support pans, and at least one rib located internally along the middle of each wall of the column shaped member for the purpose of providing support for the wall.

10. A column according to claim 9 wherein the ribs are secured to the skin via two sided tape.

11. A column according to claim 10 wherein the skin is secured to the support pans via two sided tape.

12. A column according to claim 11 wherein the notched angle member is secured to the bottom edges of the walls via two sided tape.

13. A column according to claim 12 wherein the support pans are secured to the ribs via two sided tape.

14. A column according to claim 12 wherein the support pans are secured to the ribs via rivets.

15. A column according to claim 12 wherein further comprising:

washers secured between the tabs and the bottom of the walls.

16. A column according to claim 1 further comprising:

a finish material applied externally on the top and on the skin.

* * * * *